US012729928B2

(12) United States Patent
Coombs et al.

(10) Patent No.: US 12,729,928 B2
(45) Date of Patent: Sep. 8, 2026

(54) BOLT ACTION RIFLE CHASSIS

(71) Applicant: AMEND2, LLC, Idaho Falls, ID (US)

(72) Inventors: Colby Coombs, Idaho Falls, ID (US); Matthew Bellitti, Idaho Falls, ID (US); Austin Damoth, Idaho Falls, ID (US); Craig Lockwood, Idaho Falls, ID (US)

(73) Assignee: Amend2, LLC, Idaho Falls, ID (US)

( * ) Notice: Subject to any disclaimer, the term of this patent is extended or adjusted under 35 U.S.C. 154(b) by 0 days.

(21) Appl. No.: 18/097,794

(22) Filed: Jan. 17, 2023

(65) Prior Publication Data

US 2023/0258423 A1 Aug. 17, 2023

Related U.S. Application Data

(60) Provisional application No. 63/345,567, filed on May 25, 2022, provisional application No. 63/299,827, filed on Jan. 14, 2022, provisional application No. 63/299,818, filed on Jan. 14, 2022.

(51) Int. Cl.

| | |
|---|---|
| ***F41A 11/02*** | (2006.01) |
| ***F41A 3/64*** | (2006.01) |
| ***F41A 3/66*** | (2006.01) |
| ***F41A 11/00*** | (2006.01) |
| ***F41C 23/00*** | (2006.01) |
| ***F41C 23/06*** | (2006.01) |

(52) U.S. Cl.

CPC ..... *F41C 23/06* (2013.01); *F41A 3/64* (2013.01); *F41A 3/66* (2013.01); *F41A 11/00* (2013.01); *F41A 11/02* (2013.01); *F41C 23/00* (2013.01)

(58) Field of Classification Search

CPC ..... F41A 11/00; F41A 21/481; F41A 11/02; F41A 3/64; F41A 23/00; F41A 23/06

See application file for complete search history.

(56) References Cited

U.S. PATENT DOCUMENTS

| | | | | | |
|---|---|---|---|---|---|
| 1,567,993 | A * | 12/1925 | Gerstenberger | F41A 21/484 | 42/72 |
| 3,206,885 | A * | 9/1965 | Dye | F41C 23/00 | 42/75.03 |
| 3,439,441 | A * | 4/1969 | Lawley | F41C 23/00 | 42/75.01 |
| 4,312,146 | A * | 1/1982 | Koon, Jr. | F41C 23/00 | 42/75.03 |
| 4,378,615 | A * | 4/1983 | Gunther | F16B 5/10 | 411/555 |

(Continued)

FOREIGN PATENT DOCUMENTS

FR 2588368 A1 * 4/1987

OTHER PUBLICATIONS

Definition of "form". Collins English Dictionary—Complete and Unabridged, 12th Edition 2014 © HarperCollins Publishers 1991, 1994, 1998, 2000, 2003, 2006, 2007, 2009, 2011, 2014. (Year: 2014).*

(Continued)

*Primary Examiner* — Gabriel J. Klein

(74) *Attorney, Agent, or Firm* — Travis Banta; Ascent IP Law

(57) ABSTRACT

A chassis includes an internal portion which corresponds to a rifle action of a first type. The chassis further includes an external portion which corresponds with a rifle stock. The chassis is attached to the rifle action of the first type and to rifle stock.

15 Claims, 9 Drawing Sheets

(56) References Cited

U.S. PATENT DOCUMENTS

| | | | | | |
|---|---|---|---|---|---|
| 4,385,464 | A * | 5/1983 | Casull | F41C 23/00 | 42/75.03 |
| 4,755,092 | A * | 7/1988 | Yaniv | F16B 21/02 | 411/436 |
| 5,647,591 | A * | 7/1997 | Parsons | F41B 15/02 | 463/47.4 |
| 6,487,805 | B1 * | 12/2002 | Reynolds | F41A 21/485 | 42/75.03 |
| 6,886,286 | B2 * | 5/2005 | Dowding | F41C 23/00 | 42/71.01 |
| 7,726,060 | B1 * | 6/2010 | Jones | F41C 23/00 | 42/75.02 |
| 7,841,119 | B1 * | 11/2010 | Boyd | F41C 23/16 | 42/71.01 |
| 10,859,342 | B2 * | 12/2020 | Ludlow | F41C 23/16 | |
| 2004/0211104 | A1 * | 10/2004 | Eberle | F41C 23/14 | 42/71.02 |
| 2007/0196196 | A1 * | 8/2007 | Schorling | F16B 21/04 | 411/555 |
| 2012/0180360 | A1 * | 7/2012 | Jones | F41C 23/20 | 42/75.03 |
| 2012/0304520 | A1 * | 12/2012 | Battaglia | F41A 3/66 | 42/75.03 |
| 2013/0081316 | A1 * | 4/2013 | Klotz | F41C 23/00 | 42/75.03 |

OTHER PUBLICATIONS

Definition of "in". Collins English Dictionary—Complete and Unabridged, 12th Edition 2014 © HarperCollins Publishers 1991, 1994, 1998, 2000, 2003, 2006, 2007, 2009, 2011, 2014 (Year: 2014).*

Definition of "in". American Heritage® Dictionary of the English Language, Fifth Edition. Copyright © 2016 by Houghton Mifflin Harcourt Publishing Company. Published by Houghton Mifflin Harcourt Publishing Company. (Year: 2016).*

* cited by examiner

BOLT ACTION RIFLE CHASSIS

PRIORITY CLAIM

This application claims the priority and benefit of U.S. Provisional Patent Application No. 63/299,818 filed on Jan. 14, 2022, United States Provisional Patent Application No. 63/299,827 filed on Jan. 14, 2022, and U.S. Provisional Patent Application No. 63/345,567 filed on May 25, 2022, which are each incorporated by reference in their respective entireties.

BACKGROUND

Modern bolt action rifles have been developed to be precision tools. However, this precision came about due to many years of examination, testing, and engineering to correct elements of bolt action rifles that made these rifles less precise.

Bolt action rifles were a natural improvement in breech loading rifles that used percussion caps. As metallic cartridge ammunition was developed, there was less need or desire to interact with the generation of the spark necessary to ignite a rifle shot in percussion rifles, for example. The fact that many of these rifles were particularly dirty due to the use of black powder and external percussion caps were also a major drawback to breech loading rifles. While some bolt action rifles operated with black powder breech loading mechanism, these bolt action rifles are not considered modern bolt action rifles due to their use of black powder instead of smokeless powder and cartridge ammunition.

The first modern bolt action rifles were developed just prior to the American Civil War and became highly desirable due to their relative accuracy and the repeatability of firing with cartridge ammunition. The number of shots that a soldier could fire increased significantly with the development of the repeating rifle, specifically lever action and bolt action rifles. Further, development of bolt action rifles was not limited to the United States. Popular European and Russian designs such as the Mauser, Lee-Enfield, and Moisin-Nagant used bolt actions. The United States Springfield M1903 was the battle rifle of choice for American soldiers in World War I and featured a Mauser style bolt action design. For the time, bolt action rifles had an unrivaled and incomparable accuracy for a variety of reasons. Among those reasons are that a rotating bolt secured a single ammunition cartridge into a chamber of a rifle. The bolt was used to extract a spent case, cock the trigger for subsequent firing, and loading a new cartridge into the chamber. Once the new cartridge is secured in the chamber, the bolt was locked and held motionless to secure that ammunition cartridge into the chamber of the rifle. This "fixed" position for the bolt relative to the ammunition cartridge and chamber of the rifle in a bolt action rifle provides a significant improvement in the accuracy and precision of a rifle.

It would be unfair to say that bolt action rifles lost favor after World War I because bolt action rifles are extremely popular for hunters, particularly those hunters that pursue big game and/or dangerous game. However, a division occurred at the beginning of World War II when the semi-automatic rifle became the standard battle rifle for soldiers entering the conflict. While early on in World War II, the M1903 Springfield bolt action rifle was used, it soon gave way to the M1 Garand, which soldiers hailed as one of the primary reasons for the American victories in the European and Pacific theaters. At the same time, the Russian and German standard soldier battle rifle was still a bolt action rifle. Thus, even though the United States moved into the realm of semi-automatic rifles, bolt action rifles were still prized for their simplicity and accuracy, which even surpassed the accuracy of the new semi-automatic rifles. Bolt action rifles have, since their advent, been the preferred rifle for snipers because of the precision and accuracy native to their design.

Modern bolt action rifles are still, even today, the weapon of choice for long range or precision shooting and hunting as mankind has yet to develop a more accurate single-man usable rifle that is more accurate than a bolt action rifle. Thus, bolt action rifles are highly prized for hunting and long range shooting applications. Bolt action rifles not only have the ability to be accurate in any caliber, but also have the potential to be hyper-accurate.

Hyper-accurate bolt action rifles are typically, however, improved from factory condition. While many manufacturers guarantee sub-minute-of-angle accuracy from the factory, many bolt action rifles are simply not that accurate due to the mass production of parts. In a bolt action rifle, for example, a portion of a stock contacting the barrel of the rifle may cause significant reductions in the relative accuracy of the rifle. Loose stock screws, expansion of the barrel due to multiple subsequent shots, barrel thickness, ambient temperatures, and a host of other factors can cause a rifle to lose accuracy that it would have in ideal conditions. To address many of these issues, enthusiasts replace barrels to be less sensitive to temperature changes and perform a task called "bedding the action" to ensure that the bolt action rifle fits securely and exactly into a rifle stock. Enthusiasts may also "free float" the barrel to ensure that the barrel does not come into contact with a rifle stock at any point and is only connected to the action of the rifle at a single point, typically by screwing the barrel into the action of the rifle. Many of these improvements are simply not available in a factory configuration. Notwithstanding, these improvements are imperative to obtaining hyper accuracy in a bolt action rifle.

One drawback is that to bed the action of a rifle and to free float a barrel in a rifle stock requires that the same rifle stock be used regardless of whether a person is hunting or target shooting. Thus, these stocks can be suitable for hunting or for long range target shooting, but typically not both. Typically, hunters who are hiking and stalking game desire a lighter stock that is easier to carry. Target shooters prefer stocks that are heavier and more ergonomic because they are not required to pack a rifle in search of game. Most target shooting is done from either a sitting position on a bench or in a prone position lying down on the ground where the weight of a rifle will not be a factor.

Many people who both hunt and shoot targets at long range have multiple stocks that are switched out for different activities. This requires that each stock be properly bedded for a particular rifle action and free floated to ensure that shooting performance is equal between the different stocks. Thus, using different stocks requires significant expense in bedding two different rifle actions and free floating the barrels. In addition, the rifle's "zero," or point of aim must be adjusted each time a rifle stock is changed (e.g., the positioning of the rifle scope relative to how the action is fit into the stock). This requires that the shooter shoot the rifle to re-zero the rifle, which also takes considerable time and expense in ammunition necessary to zero the rifle.

Thus, there is a need and desire in the hunting and long range shooting community, for a system which allows shooters to change stocks without having to re-zero a bolt action rifle. There is also a need and desire in the hunting and long range community to provide an easy to use simple interlocking system to attach a rifle action and barrel to a stock without significant tools, time, or changes to the rifle.

SUMMARY OF THE DISCLOSURE

Disclosed herein is a bolt action rifle chassis. The chassis may include an internal portion which corresponds to a bolt action rifle of a first type. The chassis may also include an external portion which corresponds with a rifle stock. The chassis connects to the bolt action rifle of the first type and to the rifle stock.

Disclosed herein is also a chassis for a rifle action including a rifle stock. The chassis may include an internal portion which connects to a rifle action of a first type. The chassis may further include an external portion which connects to a rifle stock. The chassis connects to the rifle action of the first type. The chassis also connects to the rifle stock by a bolt having a shank groove and a detent which interacts with a pin disposed in the chassis.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

In the following description of the disclosure, reference is made to the accompanying drawings, which form a part hereof, and in which is shown by way of illustration specific implementations in which the disclosure is may be practiced. It is understood that other implementations may be utilized, and structural changes may be made without departing from the scope of the disclosure.

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are displayed or described in another embodiment or figure. In other words, elements in the figures may be interchangeable between various embodiments disclosed herein, whether shown or not.

Figure 1:
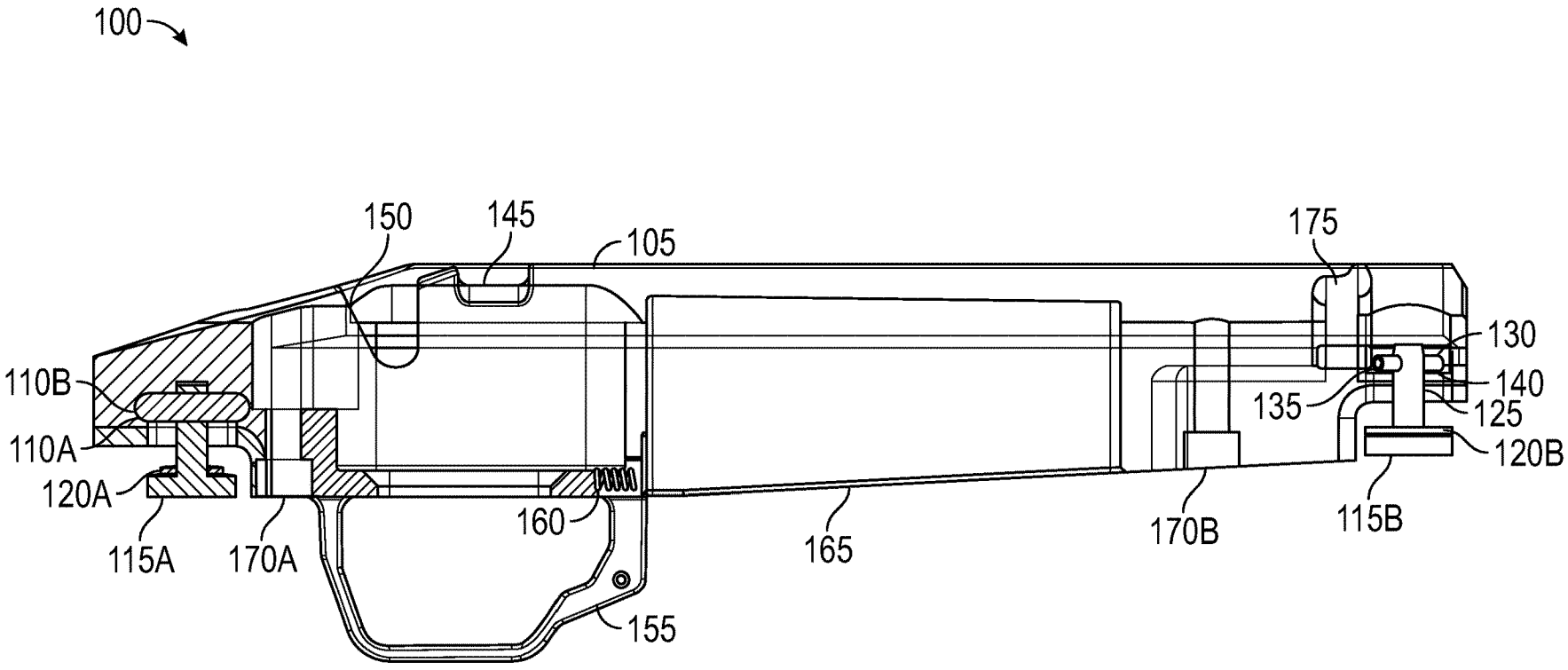
FIG. 1 illustrates a side view of a bolt action rifle chassis.

FIG. 1 illustrates a side view of a bolt action rifle chassis 100. Bolt action rifle chassis 100 may incorporate a body 105 that may be constructed using a metal such as steel, aluminum, titanium, metal alloys, carbon fiber, and any other metal or material suitable for the construction of firearms and known to those of ordinary skill in the art. Bolt action rifle chassis 100 (also "chassis 100") may be fitted into a rifle stock and may also receive into it, a bolt action rifle action, as will be discussed below. In one manner of speaking, one embodiment of chassis 100 may be an adapter which allows a bolt action rifle action made by any manufacturer to be connected into a rifle stock which is universal and accepts any chassis made to fit any rifle made by any rifle manufacturer. In this way, chassis 100 may allow a rifle to be moved from one stock to another without the need to re-zero the rifle, eliminate the need to bed the action, and allow a user to use a particular stock which makes a bolt action rifle more suitable for one activity than another (long range bench rested target shooting vs. hunting, for example).

Chassis 100 may include an aperture 110A which accepts a chassis lock 110B. Aperture 110A and chassis lock 110B may be complimentary in shape such that chassis lock 110B may slide into aperture 110A with precision tolerances that prevent movement of chassis lock 110B within aperture 110A. Inaccurate tolerances or movement between chassis lock 110B within aperture 110A may affect the accuracy of a bolt action rifle due to movement of the bolt action rifle action relative to the stock. Chassis lock 110B may be fitted with an inclined surface and implement the same structure that is shown with bolt 115B and operate in the same manner to that as discussed with respect to bolt 115B, below. Chassis lock 110B may be secured in place by bolt 115A in a rear portion of chassis 100. Bolt 115A may be fitted with a spacer 120A which provides for a rigid connection between a rifle stock and chassis 100, as will be described below.

A front portion of chassis 100 may also include a bolt 115B which includes a spacer 120B. Bolt 115B may be fitted through a mounting hole 125 installed in chassis 100 which allows bolt 115B to enter to an internal portion of chassis 100, as will be described below. Bolt 115B may further include a cross pin 130 which may interact with a helically inclined surface 135 within chassis 100. In other words, cross pin 130 may slide up helically inclined surface 135 within chassis 100 which draws bolt 115B into chassis 100 to the point where cross pin 130 drops into detent 140. When installed through a rifle stock, bolt 115B is rotated, rotating cross pin 130 up the helically inclined surface 135 which causes compression between bolt 115B compressing a rifle stock (discussed below) into chassis 100. In this manner, a rigid connection may be made between a rifle stock and chassis 100 to ensure that the rifle stock is secured to chassis 100 without movement between chassis 100 and the rifle stock.

Chassis 100 may include other elements which support the function of a bolt action rifle. For example, chassis 100 may optionally be fitted with a recess 145, a bolt recess 150 which allows a bolt action rifle to be properly opened and closed, and a trigger guard 155 which is intended to prevent a trigger from being accidentally actuated. Chassis 100 may further include a spring 160 which facilitates insertion and removal of a magazine (or magazine plate) for magazine 165.

Chassis 100 may further include take down screw holes 170A and 170B. Conventional bolt action rifles use take down screws to secure a bolt action rifle action to a rifle stock. In other words, take down screws are inserted through the stock and into the bolt action rifle action to hold the bolt action rifle action to the stock. Chassis 100 supplies take down screw holes 170A and 170B in the same location as corresponding take down holes (threaded holes, typically) on a manufacturer by manufacturer or rifle model by rifle model basis, as a connection point between chassis 100 and a bolt action rifle action. Bolts may be used to secure chassis 100 to a bolt action rifle action using the standard placement for a particular model of bolt action rifle to secure the bolt action rifle action to the chassis and no longer use those bolts to secure the bolt action rifle action to a rifle stock. Similarly, a recoil lug receiver 175 is installed within chassis 100 which allows bolt action rifles of a specific make or model to be installed within chassis 100. It is to be understood that chassis 100 is merely representative of one chassis that may be used for a specific bolt action rifle, such as a Remington® 700. In other words, chassis 100 may have different internal dimensions and take down screw locations based on chassis 100 being intended for use with a Remington® 700 rifle versus being intended for use with a Ruger® American rifle. However, the external dimensions of chassis 100 may be identical, regardless of make and model to allow chassis 100 to fit into a universal rifle stock made to fit chassis 100 with precision tolerances. Simply put chassis 100 serves as an interface for a specific rifle make and model and a universal rifle stock, providing independent connections for each interface.

Figure 2:
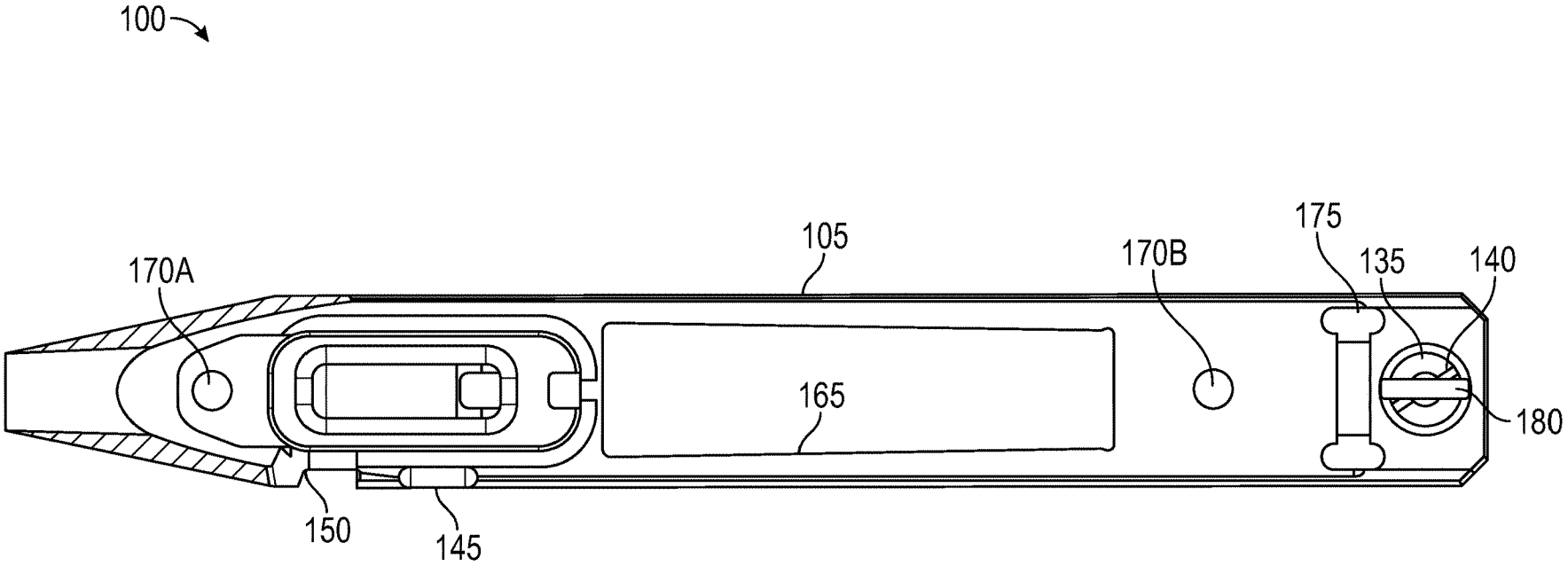
FIG. 2 illustrates a top view of a bolt action rifle chassis.

FIG. 2 illustrates a top view of bolt action rifle chassis 100. As discussed above, chassis 100 may include a body 105 which may be constructed using any suitable material known to those of ordinary skill in the art. Chassis 100 may further include the elements discussed above with respect to FIG. 1, not all of which are shown in FIG. 2 due to perspective. However, as shown in FIG. 2, chassis 100 may include a helically inclined surface 135 which may interact with cross pin 130 on bolt 115B, for example. As cross pin 130 and bolt 115B are turned, bolt 115B is tightened (e.g., compressed) against a rifle stock with a constant compression force when cross pin 130 reaches detent 140 in chassis 100. As shown in FIG. 2, an aperture 180, shaped to accept bolt 115A and cross pin 130, is installed in chassis 100 to allow bolt 115A and cross pin 130 access to helically inclined surface 135.

As further shown in FIG. 2, chassis 100 may include functional recesses, such as optional recess 145 and bolt recess 150. Bolt recess 150 allows a bolt in a bolt action rifle to be raised and lowered, locking a breech of the bolt in firing position when an ammunition cartridge is in battery. Chassis 100 may further include a magazine 165 which may be implemented with a detachable magazine, or a magazine plate which holds ammunition internally within a rifle stock.

Chassis 100 may further include take down screw holes 170A and 170B which may be positioned to interface with a bolt action rifle action of a particular make and model. Take down screw holes 170A and 170B are positioned within chassis 105 and correspond with threaded take down screw holes in a bolt action rifle action and serve as the connection point between chassis 100 and a bolt action rifle action. Similarly, a recoil lug receiver 175 may be positioned within chassis 100 in a location that corresponds to a similar make and model of recoil lug for a bolt action rifle action. A recoil lug is a feature in bolt action rifles which anchors the action and transfers recoil energy produced by firing an ammunition cartridge into a rifle stock instead of containing all of the recoil energy within the bolt action rifle action itself.

Figure 3:
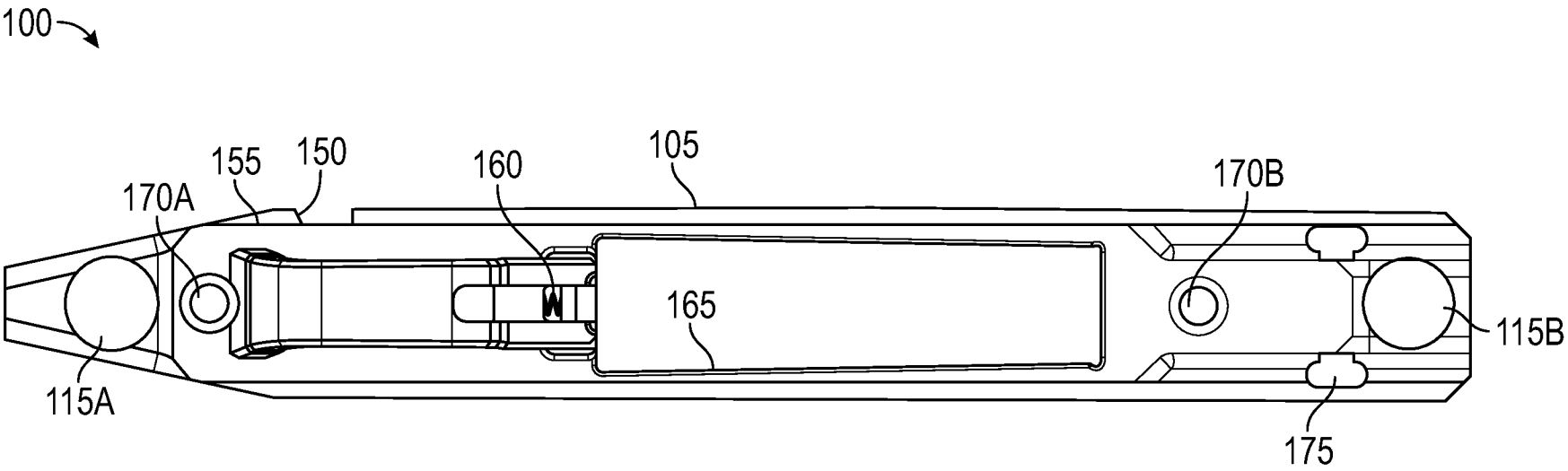
FIG. 3 illustrates a bottom view of a bolt action rifle chassis.

FIG. 3 illustrates a bottom view of a bolt action rifle chassis 100. As discussed above, chassis 100 may include a body 105 which may be constructed using any suitable material known to those of ordinary skill in the art. Chassis 100 may incorporate the elements shown in FIGS. 2 and 3, above, not all of which are shown in FIG. 3 due to perspective. Chassis 100 may include a bolt 115A and a bolt 115B are intended to secure chassis 100 to a rifle stock. For example, chassis 100 may be installed within a rifle stock while bolts 115A and 115B may be installed on an underside of a rifle stock and attach the chassis to the rifle stock using helically inclined surfaces 135 (shown in FIG. 1 and FIG. 2) within chassis 100 and chassis lock 110A. As bolt 115A and bolt 115B are turned, a compression force is exerted between chassis 100 and a rifle stock to ensure a rigid connection between chassis 100 and a rifle stock.

As previously discussed, chassis 100 may implement a number of functional elements such as bolt recess 150, trigger guard 155, and magazine catch spring 160. Chassis 100 may further include a magazine 165 which allows a detachable magazine or an internal magazine to be installed within chassis 100.

Chassis 100 may further include take down screw holes 170A and 170B which may be positioned to interface with a bolt action rifle action of a particular make and model. Take down screw holes 170A and 170B are positioned within chassis 100 and correspond with threaded take down screw holes in a bolt action rifle action and serve as the connection point between chassis 100 and a bolt action rifle action. Similarly, a recoil lug receiver 175 may be positioned within chassis 100 in a location that corresponds to a similar make and model of recoil lug for a bolt action rifle action. A recoil lug is a feature in bolt action rifles which anchors the action and transfers recoil energy produced by firing an ammunition cartridge into a rifle stock instead of containing all of the recoil energy within the bolt action rifle action itself.

Figure 4:
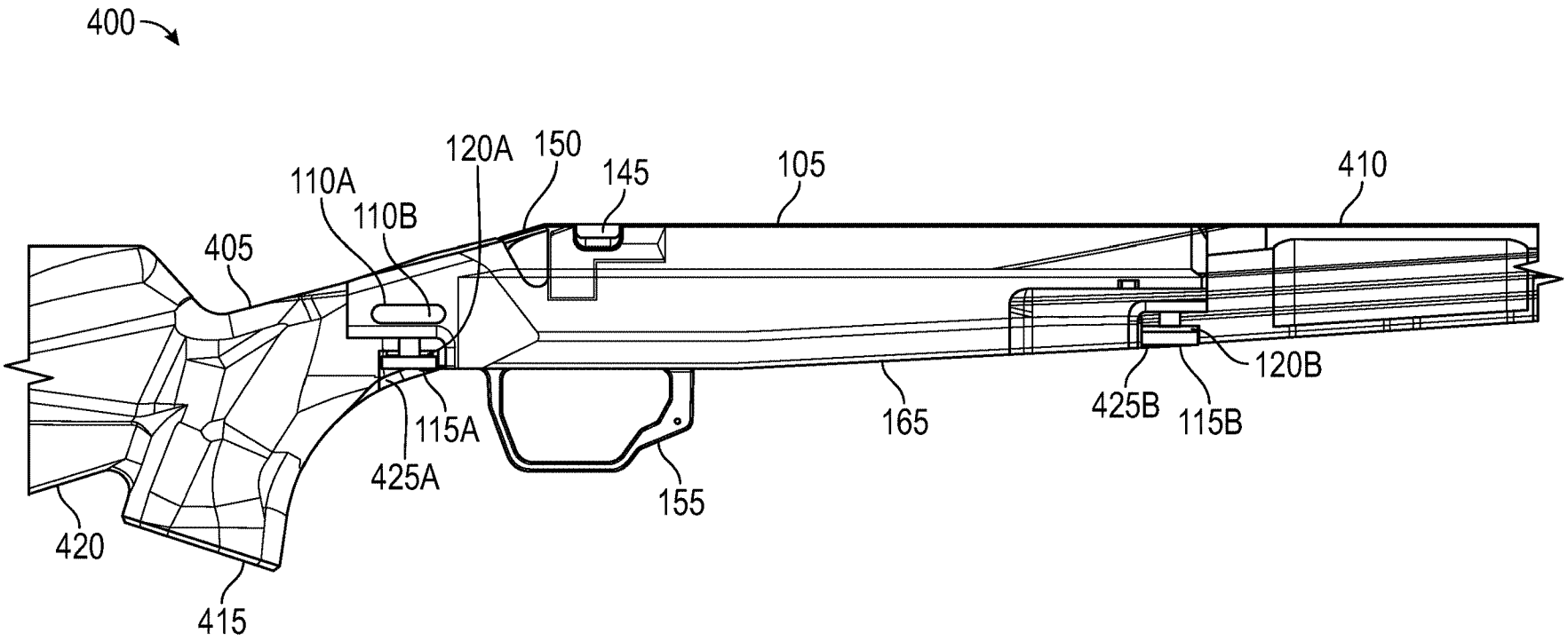
FIG. 4 illustrates a side view of a bolt action rifle chassis in a rifle stock.

FIG. 4 illustrates a side view of a bolt action rifle chassis 400 in a rifle stock 405. Rifle stock 405 may be constructed of wood, plastics of types known to those of ordinary skill in the art, fiberglass, fiberglass composites, and any other material known to those of ordinary skill in the art. Rifle stock 405 may implement conventional elements such as a fore end 410, a grip 415, a butt section 420, and stock bolt holes 425A/425B. It is also noted that rifle stock 405 may be implemented in any conventional manner known for rifle stocks. For example, rifle stock 405 may be made from separate and discrete pieces, may have a fore end that is separate from a butt end, or may implement machined chassis style stock elements. The term "rifle stock" is intended to be inclusive of any type of stock or interface for a man operated rifle. However, rifle stock 405 further implements chassis 400 and provides a universal interface for chassis 400, that is intended to interface with a particular make and model of bolt action rifle. For example, chassis 400 may receive a bolt action rifle action for a first make and model (e.g., type) of bolt action rifle but also interface with any rifle stock 405 patterned to receive chassis 400. While an internal portion of chassis 400 may be specifically implemented to suit a particular make and model or type of bolt action rifle, chassis 400 may be unsuitable for another particular make and model or type of bolt action rifle. At the same time, however, a chassis 400 that does fit either the first or second type of bolt action rifle will fit within stock 405 because stock 405 is adapted to receive chassis 400 as the external dimensions of chassis 400 are sized to cooperatively interface with any stock 405. It should also be noted that a single stock may be exchanged between any two bolt action rifle actions that implement a chassis 400 which is specific to that particular type of bolt action rifle action.

Bolt action rifle chassis 400 may be similar to bolt action rifle chassis 100, shown and discussed above with respect to FIGS. 1-3 and may incorporate a body 105 that may be constructed using a metal such as steel, aluminum, titanium, metal alloys, carbon fiber, and any other metal or material suitable for the construction of firearms and known to those of ordinary skill in the art. Bolt action rifle chassis 400 (also "chassis 400") may be fitted into a rifle stock 405 and may also receive into it, a bolt action rifle action, as will be discussed below. In one manner of speaking, one embodiment of chassis 400 may be an adapter which allows a bolt action rifle action made by any manufacturer to be connected into rifle stock 405 which is universal and accepts any chassis made to fit a rifle made by a rifle manufacturer. In this way, chassis 400 may allow a rifle to be moved from one stock to another without the need to re-zero the rifle, eliminate the need to bed the action, and allow a user to use a particular stock which makes a bolt action rifle more suitable for one activity than another (long range bench rested target shooting vs. hunting, for example).

Chassis 400 may include an aperture 110A which accepts a chassis lock 110B. Aperture 110A and chassis lock 110B may be complimentary in shape such that chassis lock 110A may slide into aperture 110A with precision tolerances that prevent movement of chassis lock 110B within aperture 110A. Inaccurate tolerances or movement between chassis lock 110B within aperture 110A may affect the accuracy of a bolt action rifle due to movement of the bolt action rifle action relative to rifle stock 405. Chassis lock 110B may be fitted with an inclined surface and implement the same structure that is shown with bolt 115B and operate in the same manner to that as discussed with respect to bolt 115B, below. Chassis lock 110B may be secured in place by bolt 115A in a rear portion of chassis 100. Bolt 115A may be fitted with a spacer 120A which provides for a rigid connection between rifle stock 405 and chassis 405, as will be described below.

A front portion of chassis 400 may also include a bolt 115B which includes a spacer 120B. Bolt 115B may be fitted through a mounting hole 125 installed in chassis 100 which allows bolt 115*b* to enter to an internal portion of chassis 400, as will be described below. Bolt 115B may further include a cross pin 130 which may interact with a helically inclined surface 135 within chassis 100 (or chassis lock 110B). In other words, cross pin 130 may slide up helically inclined surface 135 within chassis 100 which draws bolt 115B into chassis 400 to the point where cross pin 130 drops into detent 140. When installed through rifle stock 405 in bolt hole 425B, bolt 115B is rotated, rotating cross pin 130 up the helically inclined surface 135 which causes compression between bolt 115B compressing rifle stock 405 into chassis 400. In this manner, a rigid connection may be made between a rifle stock and chassis 400 to ensure that rifle stock 405 is secured to chassis 400 without movement between chassis 400 and rifle stock 405.

Chassis 400 may include other elements which support the function of a bolt action rifle. For example, chassis 400 may optionally be fitted with a recess 145, a bolt recess 150 which allows a bolt action rifle to be properly opened and closed, and a trigger guard 155 which is intended to prevent a trigger from being accidentally actuated. Chassis 400 may further include a spring 160 which facilitates insertion and removal of a magazine (or magazine plate) for magazine 165.

Figure 5:
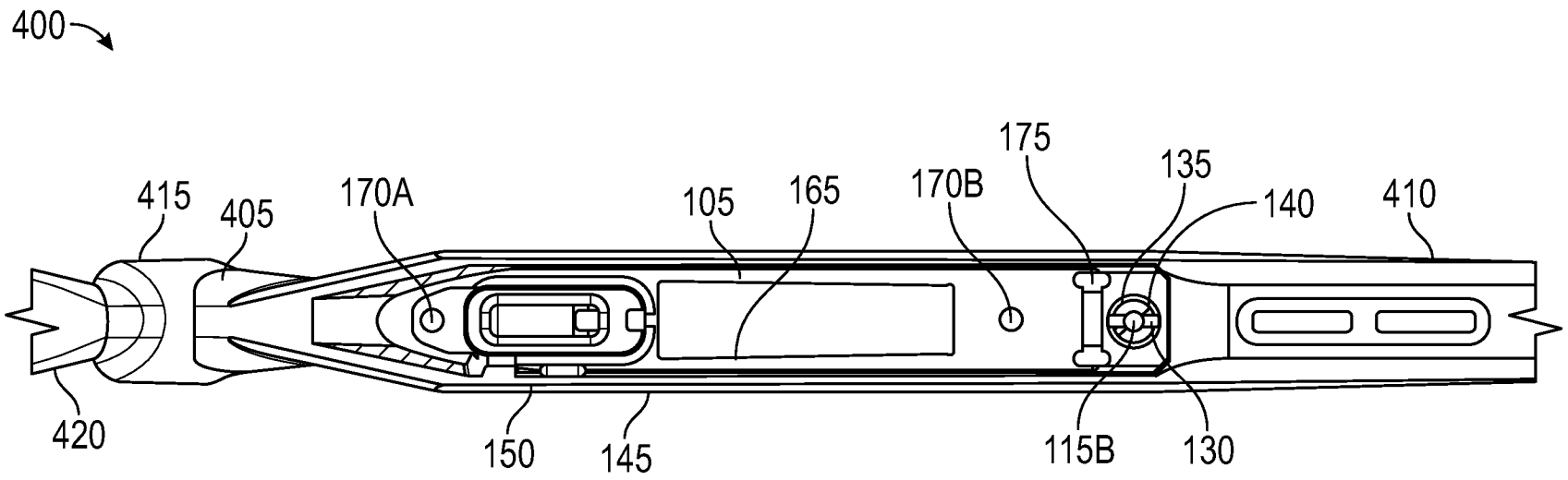
FIG. 5 illustrates a top view of a bolt action rifle chassis in a rifle stock.

FIG. 5 illustrates a top view of a bolt action rifle chassis 400 in a rifle stock 405. Rifle stock 405 may be constructed of wood, plastics of types known to those of ordinary skill in the art, fiberglass, fiberglass composites, and any other material known to those of ordinary skill in the art. Rifle stock 405 may implement conventional elements such as a fore end 410, a grip 415, a butt section 420, and stock bolt holes 425A/425B. As discussed above, chassis 100 may include a body 105 which may be constructed using any suitable material known to those of ordinary skill in the art. Chassis 400 may be similar to chassis 100 shown in FIGS. 1-3 and further include the elements discussed above with respect to FIGS. 1-4, not all of which are shown in FIG. 5 due to perspective. However, as shown in FIG. 5, chassis 400 may include a helically inclined surface 135 which may interact with cross pin 130 on bolt 115B, for example. As cross pin 130 and bolt 115B are turned, bolt 115B is tightened (e.g., compressed) against rifle stock 405 with a constant compression force when cross pin 130 reaches detent 140 in chassis 105. As shown in FIG. 5, an aperture 180, shaped to accept bolt 115A and cross pin 130 is installed in chassis 100 to allow bolt 115A and cross pin 130 access to helically inclined surface 135.

As further shown in FIG. 5, chassis 400 may include functional recesses, such as optional recess 145 and bolt recess 150. Bolt recess 150 allows a bolt in a bolt action rifle to be raised and lowered, locking a breech of the bolt in firing position when an ammunition cartridge is in battery. Chassis 400 may further include a magazine 165 which may be implemented with a detachable magazine, or a magazine plate which holds ammunition internally within rifle stock 405.

Chassis 400 may further include take down screw holes 170A and 170B. Conventional bolt action rifles use take down screws to secure a bolt action rifle action to a rifle stock. In other words, take down screws are inserted through the stock and into the bolt action rifle action to hold the bolt action rifle action to rifle stock 405. Chassis 400 supplies take down screw holes 170A and 170B in the same location corresponding to take down holes (threaded holes, typically) on a manufacturer by manufacturer or rifle model by rifle model basis, as a connection point between chassis 400 and a bolt action rifle action. Bolts may be used to secure chassis 400 to a bolt action rifle action using the standard placement for a particular model of bolt action rifle to secure the bolt action rifle action to the chassis and no longer use those bolts to secure the bolt action rifle action to a rifle stock 405. It should be noted that take down screw holes 170A and 170B do not extend through rifle stock 405 to an outside of rifle stock 405 as take down screw holes 170A and 170B are located specifically to a particular bolt action rifle action. Thus, while take down screw holes 170A and 170B are visible in a top down view (without a bolt action rifle action installed), take down screw holes 170A and 170B do not extend through or into rifle stock 405.

A recoil lug receiver 175 is installed within chassis 400 which allows bolt action rifles of a specific make or model to be installed within chassis 400. A recoil lug is a feature in bolt action rifles which anchors the action and transfers recoil energy produced by firing an ammunition cartridge into a rifle stock instead of containing all of the recoil energy within the bolt action rifle action itself.

It is to be understood that chassis 400 is merely representative of one chassis that may be used for a specific bolt action rifle, such as a Remington® 700. In other words, chassis 400 may have different internal dimensions and take down screw locations based on chassis 400 being intended for use with a Remington® 700 rifle versus being intended for use with a Ruger® American rifle. However, the external dimensions of chassis 400 may be identical, regardless of make and model to allow chassis 400 to fit into a universal rifle stock, such as rifle stock 405, made to fit chassis 400 with precision tolerances. Simply put chassis 400 serves as an interface for a specific rifle make and model and a universal rifle stock, such as rifle stock 405, providing independent connections for each interface.

Figure 6:
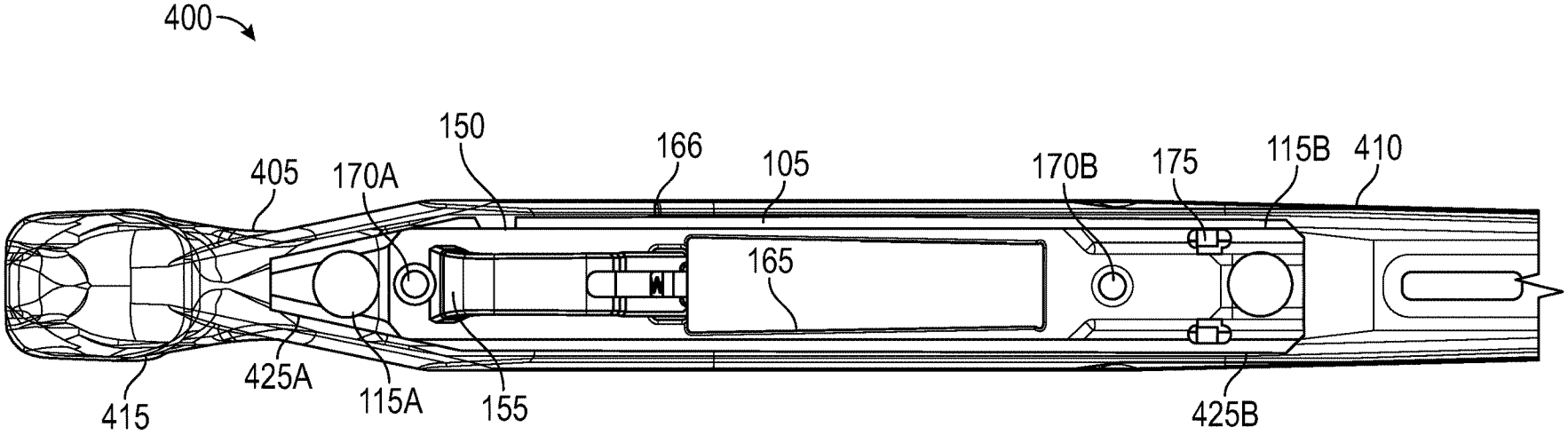
FIG. 6 illustrates a bottom view of a bolt action rifle chassis in a rifle stock.

FIG. 6 illustrates a bottom view of a bolt action rifle chassis 400 in a rifle stock 405. As discussed above, chassis 400 may include a body 105 which may be constructed using any suitable material known to those of ordinary skill in the art. Chassis 400 may incorporate the elements shown in FIGS. 1-5, above, not all of which are shown in FIG. 6 due to perspective. Chassis 400 may include a bolt 115A and a bolt 115B which are intended to secure chassis 400 to a rifle stock 405. For example, chassis 400 may be installed within rifle stock 405 while bolts 115A and 115B may be installed on an underside of a rifle stock and attach the chassis to rifle stock 405 using helically inclined surfaces 135 (shown in FIG. 5) within chassis 400 and chassis lock 110A. As bolt 115A and bolt 115B are turned, a compression force is exerted between chassis 400 and rifle stock 405 to ensure a rigid connection between chassis 400 and rifle stock 405.

As previously discussed, chassis 400 may implement a number of functional elements such as bolt recess 150, trigger guard 155, and magazine catch spring 160. Chassis 400 may further include a magazine 165 which allows a detachable magazine or an internal magazine to be installed within chassis 400.

Chassis 400 may further include take down screw holes 170A and 170B which may be positioned to interface with a bolt action rifle action of a particular make and model. While take down screws 170A and 170B are visible in FIG. 6, this is due to a cut away of a bottom side of stock 405 to show detail from a bottom perspective. Take down screws 170A and 170B do not extend through rifle stock 405. Take down screw holes 170A and 170B are positioned within chassis 400 and correspond with threaded take down screw holes in a bolt action rifle action and serve as the connection point between chassis 400 and a bolt action rifle action. Similarly, a recoil lug receiver 175 may be positioned within chassis 400 in a location that corresponds to a similar make and model of recoil lug for a bolt action rifle action.

Figure 7:
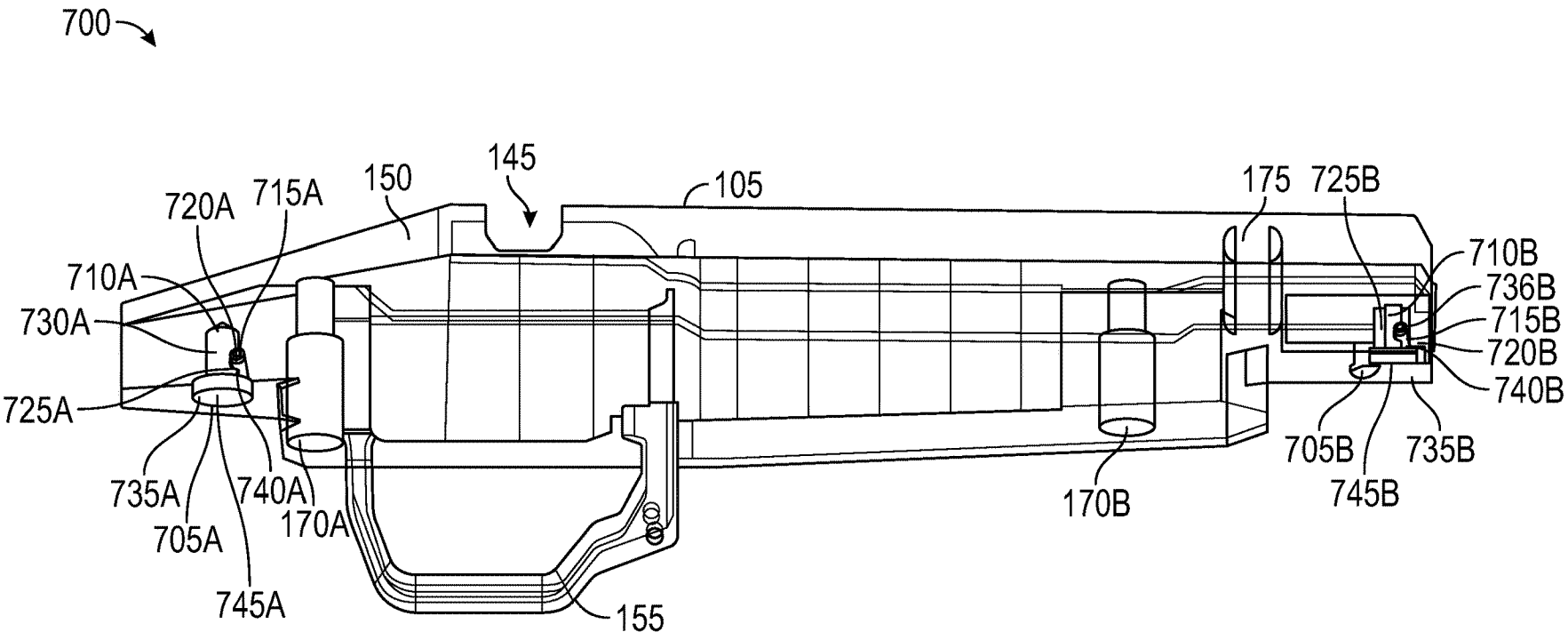
FIG. 7 illustrates a side view of a bolt action rifle chassis.

FIG. 7 illustrates a side view of a bolt action rifle chassis 700. Bolt action rifle chassis 700 may incorporate a body 105 that may be constructed using a metal such as steel, aluminum, titanium, metal alloys, carbon fiber, and any other metal or material suitable for the construction of firearms and known to those of ordinary skill in the art. Bolt action rifle chassis 700 (also "chassis 700") may be fitted into a rifle stock and may also receive into it, a bolt action rifle action, as will be discussed below. In one manner of speaking, one embodiment of chassis 700 may be an adapter which allows a bolt action rifle action made by any manufacturer to be connected into a rifle stock which is universal and accepts any chassis made to fit any rifle made by any rifle manufacturer. In this way, chassis 700 may allow a rifle to be moved from one stock to another without the need to re-zero the rifle, eliminate the need to bed the action, and allow a user to use a particular stock which makes a bolt action rifle more suitable for one activity than another (long range bench rested target shooting vs. hunting, for example).

A back portion of chassis 700 may include a mounting hole 710A which accepts a bolt 705A allowing bolt 705A to enter to an internal portion of chassis 700. Mounting hole 710A and bolt 705A may be complimentary in shape such that bolt 705A may slide into mounting hole 710A with precision tolerances that prevent movement of bolt 705A within mounting hole 710A. Inaccurate tolerances or movement between bolt 705A within mounting hole 710A may affect the accuracy of a bolt action rifle due to movement of the bolt action rifle action relative to the stock. Bolt 705A may be held in place within mounting hole 710A by pin 715A, as will be described below. Chassis 700 may include a pinhole 720A which accepts pin 715A such that pin 715A resides against bolt 705A when bolt 705A is inserted into mounting hole 710A. Pin 715A may be installed through pinhole 720A or, alternatively, be formed within chassis 700 as a non-removable portion of chassis 700. A front portion of chassis 700 may also include a mounting hole 710B which accepts a bolt 705B allowing bolt 705B to enter to an internal portion of chassis 700. Mounting hole 710B and bolt 705B may be complimentary in shape such that bolt 705B may slide into mounting hole 710B with precision tolerances that prevent movement of bolt 705B within mounting hole 710B. Inaccurate tolerances or movement between bolt 705B within mounting hole 710B may affect the accuracy of a bolt action rifle due to movement of the bolt action rifle action relative to the stock. Bolt 705B may be held in place within mounting hole 710B by pin 715B, as will be described below. Chassis 700 may include a pinhole 720B which accepts pin 715B such that pin 715B resides against bolt 705B when bolt 705B is inserted into mounting hole 710B.

Chassis 700 may include other elements which support the function of a bolt action rifle. For example, chassis 700 may optionally be fitted with a recess 145, a bolt recess 150 which allows a bolt action rifle to be properly opened and closed, and a trigger guard 155 which is intended to prevent a trigger from being accidentally actuated.

Chassis 700 may further include take down screw holes 170A and 170B. Conventional bolt action rifles use take down screws to secure a bolt action rifle action to a rifle stock. In other words, take down screws are inserted through the stock and into the bolt action rifle action to hold the bolt action rifle action to the stock. Chassis 700 supplies take down screw holes 170A and 170B in the same location as corresponding take down holes (threaded holes, typically) on a manufacturer by manufacturer or rifle model by rifle model basis, as a connection point between chassis 700 and a bolt action rifle action. Bolts may be used to secure chassis 700 to a bolt action rifle action using the standard placement for a particular model of bolt action rifle to secure the bolt action rifle action to the chassis and no longer use those bolts to secure the bolt action rifle action to a rifle stock. Similarly, a recoil lug receiver 175 is installed within chassis 700 which allows bolt action rifles of a specific make or model to be installed within chassis 700. It is to be understood that chassis 700 is merely representative of one chassis that may be used for a specific bolt action rifle, such as a Remington® 700. In other words, chassis 700 may have different internal dimensions and take down screw locations based on chassis 700 being intended for use with a Remington® 700 rifle versus being intended for use with a Ruger® American rifle. However, the external dimensions of chassis 700 may be identical, regardless of make and model to allow chassis 700 to fit into a universal rifle stock made to fit chassis 700 with precision tolerances. Simply put chassis 700 serves as an interface for a specific rifle make and model and a universal rifle stock, providing independent connections for each interface.

Figure 8:
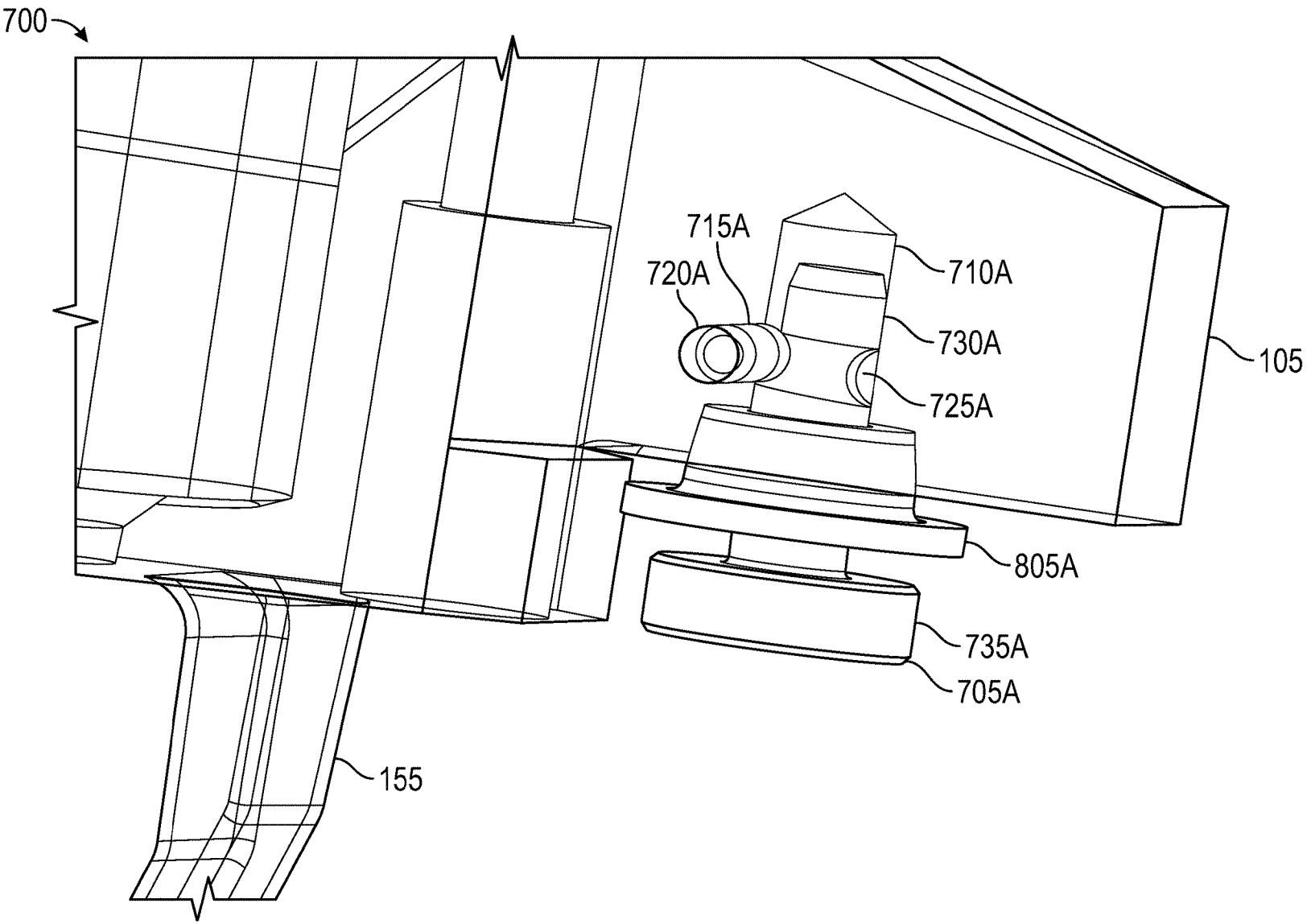
FIG. 8 illustrates a close-up perspective view of a back portion of a bolt action rifle chassis.

FIG. 8 illustrates a close-up perspective view of a back portion of a bolt action rifle chassis 700. As previously discussed, a back portion of chassis 700 may include a mounting hole 710A which accepts a bolt 705A allowing bolt 705A to enter to an internal portion of chassis 700. Bolt 705A may be held in place within mounting hole 710A by pin 715A. Chassis 700 may include a pinhole 720A which accepts pin 715A such that pin 715A resides against bolt 705A when bolt 705A is inserted into mounting hole 710A. Bolt 705A may be fitted with a helically inclined detent 725A. Helically inclined detent 725A, may be sized to fit with pin 720A. As bolt 705A is turned, bolt 705A is tightened (e.g., compressed) against a rifle stock. Friction between pin 720A and helically inclined detent 725A may hold bolt 705A in place. Bolt 705A may be fitted with a spacer 805A which provides for a rigid connection between a rifle stock and chassis 700, as will be described below.

As shown in FIG. 8, mounting hole 710A, shaped to accept bolt 705A, is installed in chassis 700 to allow bolt 705A access to pin 715A. When installed through a rifle stock, bolt 705A is rotated, rotating the relative position of the point of contact between pin 715A and helically inclined detent 725A along the bolt shank 730A toward bolt head 735A which causes compression between bolt 705A compressing a rifle stock (discussed below) into chassis 700. In this manner, a rigid connection may be made between a rifle stock and chassis 700 to ensure that the rifle stock is secured to chassis 700 without movement between chassis 700 and the rifle stock.

A front portion of chassis 700 may implement structures corresponding to those shown in FIG. 8 and operate in the same manner to those features as discussed with respect to FIG. 8, above. For example, a front portion of chassis 700 may include a mounting hole 710B which accepts a bolt 705B allowing bolt 705B to enter to an internal portion of chassis 700. Bolt 705B may be held in place within mounting hole 710B by pin 715B. Chassis 700 may include a pinhole 720B which accepts pin 715B such that pin 715B resides against bolt 705B when bolt 705B is inserted into mounting hole 710B. Bolt 705B may be fitted with a helically inclined detent 725B. Helically inclined detent 725B, may be sized to fit with pin 720B. As bolt 705B is turned, bolt 705B is tightened (e.g., compressed) against a rifle stock. Friction between pin 720B and helically inclined detent 725B may hold bolt 705B in place. Bolt 705B may be fitted with a spacer 805B (not shown) which provides for a rigid connection between a rifle stock and chassis 700, as will be described below.

A front portion of chassis 700, shown in FIG. 7, may include similar or the same parts on a front end of chassis 700. For example, a mounting hole 710B, shaped to accept bolt 705B, is installed in chassis 700 to allow bolt 705B access to pin 715B. When installed through a rifle stock, bolt 705B is rotated, rotating the relative position of the point of contact between pin 715B and helically inclined detent 725B along the bolt shank 730B toward bolt head 735B which causes compression between bolt 705B compressing a rifle stock (discussed below) into chassis 700. In this manner, a rigid connection may be made between a rifle stock and chassis 700 to ensure that the rifle stock is secured to chassis 700 without movement between chassis 700 and the rifle stock.

Figure 9:
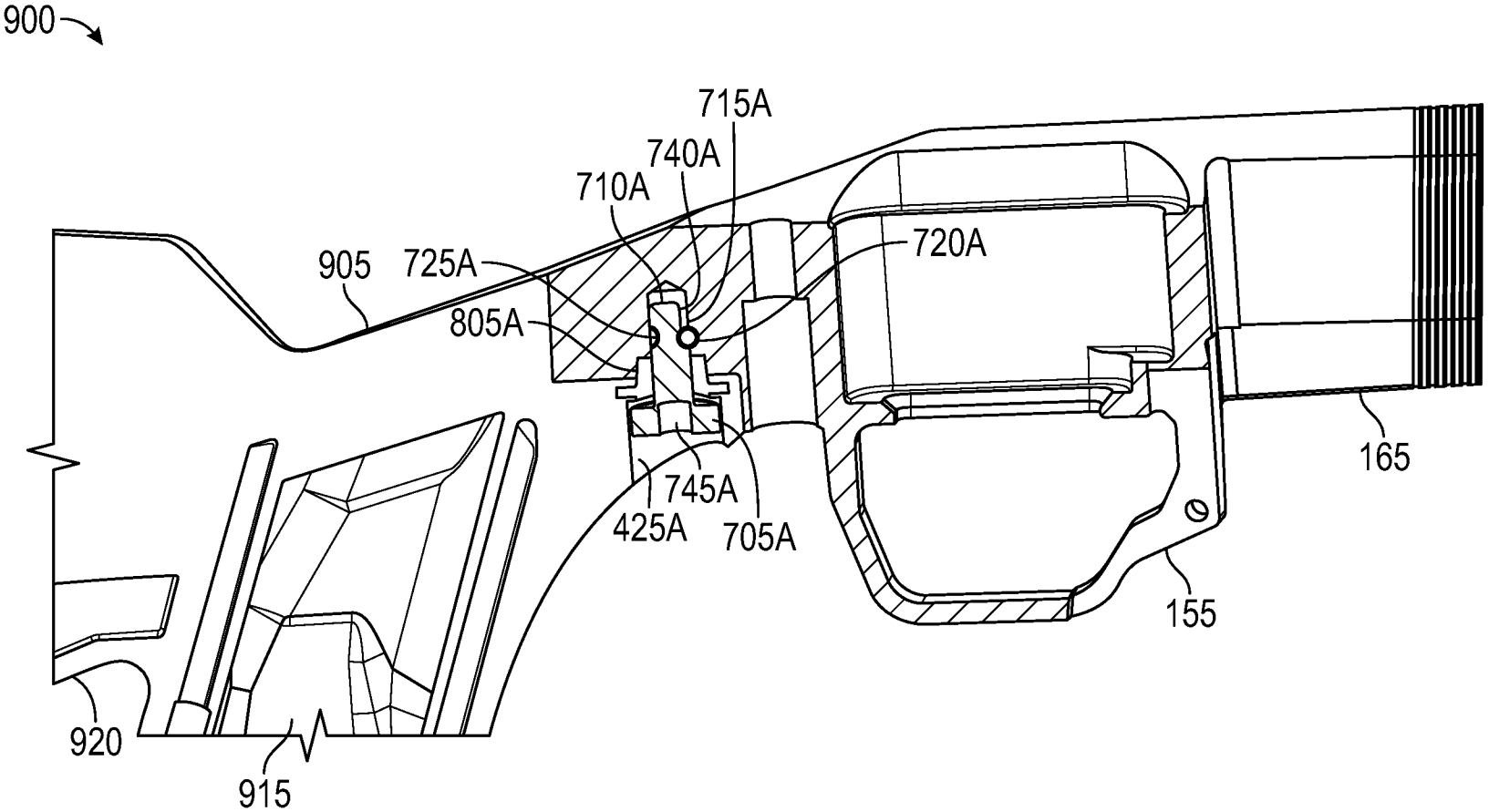
FIG. 9 illustrates a side view of a portion of a bolt action rifle chassis in a rifle stock.

FIG. 9 illustrates a side view of a portion of a bolt action rifle chassis 900 in a rifle stock 905. Rifle stock 905 may be constructed of wood, plastics of types known to those of ordinary skill in the art, fiberglass, fiberglass composites, and any other material known to those of ordinary skill in the art. Rifle stock 905 may implement conventional elements such as a fore end 910 (not shown in FIG. 9), a grip 915, a butt section 920, and stock bolt holes 925A and 925B (not shown in FIG. 9). It is also noted that rifle stock 905 may be implemented in any conventional manner known for rifle stocks. For example, rifle stock 905 may be made from separate and discrete pieces, may have a fore end that is separate from a butt end, or may implement machined chassis style stock elements. The term "rifle stock" is intended to be inclusive of any type of stock or interface for a man operated rifle. However, rifle stock 905 further implements chassis 900 and provides a universal interface for chassis 900, that is intended to interface with a particular make and model of bolt action rifle. For example, chassis 900 may receive a bolt action rifle action for a first make and model (e.g., type) of bolt action rifle but also interface with any rifle stock 905 patterned to receive chassis 900. While an internal portion of chassis 900 may be specifically implemented to suit a particular make and model or type of bolt action rifle, chassis 900 may be unsuitable for another particular make and model or type of bolt action rifle. At the same time, however, a chassis 900 that does fit either the first or second type of bolt action rifle will fit within stock 905 because stock 905 is adapted to receive chassis 900 as the external dimensions of chassis 900 are sized to cooperatively interface with any stock 905. It should also be noted that a single stock may be exchanged between any two bolt action rifle actions that implement a chassis 900 which is specific to that particular type of bolt action rifle action.

Bolt action rifle chassis 900 may be similar to bolt action rifle chassis 100, shown and discussed above with respect to FIGS. 1-3 and may incorporate a body 105 that may be constructed using a metal such as steel, aluminum, titanium, metal alloys, carbon fiber, and any other metal or material suitable for the construction of firearms and known to those of ordinary skill in the art. Bolt action rifle chassis 900 (also "chassis 900") may be fitted into a rifle stock 905 and may also receive into it, a bolt action rifle action, as will be discussed below. In one manner of speaking, one embodiment of chassis 900 may be an adapter which allows a bolt action rifle action made by any manufacturer to be connected into rifle stock 905 which is universal and accepts any chassis made to fit a rifle made by a rifle manufacturer. In this way, chassis 900 may allow a rifle to be moved from one stock to another without the need to re-zero the rifle, eliminate the need to bed the action, and allow a user to use a particular stock which makes a bolt action rifle more suitable for one activity than another (long range bench rested target shooting vs. hunting, for example).

A back portion of chassis 900 may implement structures corresponding to those shown in FIGS. 7 and 8 and operate in the same manner to those features as discussed with respect to FIG. 8, above. For example, a back portion of chassis 900 may include a mounting hole 710A which accepts a bolt 705A allowing bolt 705A to enter to an internal portion of chassis 900. Bolt 705A may be held in place within mounting hole 710A by pin 715A. Chassis 900 may include a pinhole 720A which accepts pin 715A such that pin 715A resides against bolt 705A when bolt 705A is inserted into mounting hole 710A. Bolt 705A may be fitted with a helically inclined detent 725A. Helically inclined detent 725A, may be sized to fit with pin 720A. As bolt 705A is turned, bolt 705A is tightened (e.g., compressed) against a rifle stock. Friction between pin 720A and helically inclined detent 725A may hold bolt 705A in place. Bolt 705A may be fitted with a spacer 805A which provides for a rigid connection between a rifle stock and chassis 900, as will be described below.

As shown in FIG. 9, mounting hole 710A, shaped to accept bolt 705A, is installed in chassis 900 to allow bolt 705A access to pin 715A. When installed through a rifle stock via stock bolt hole 925A, bolt 705A is rotated, rotating the relative position of the point of contact between pin 715A and helically inclined detent 725A along the bolt shank 730A toward bolt head 735A which causes compression between bolt 705A compressing a rifle stock (discussed below) into chassis 900. In this manner, a rigid connection may be made between a rifle stock and chassis 900 to ensure that the rifle stock is secured to chassis 900 without movement between chassis 900 and the rifle stock. Bolt 705A may further include keyed hole 745A to allow bolt 705A to be easily tightened. Keyed hole 745A may be designed to accommodate what is conventionally called an Allen head screw, a Phillips head screw, a slotted head screw, or other keyed hole types known to those of ordinary skill in the art. Bolt 705A may also be designed with a shank groove 740A on one side of the end of bolt 705A. The shank groove 740A may allow bolt 705A to pass by pin 715A when inserted into mounting hole 710A. Thus, shank groove 740A may be a flat surface milled or cut into bolt 705A to a certain length of the bolt. The length of shank groove 740A may correspond to helically inclined detent 725A such that when bolt 705A is turned, pin 715A interacts with detent 725A to provide a secure attachment between stock 905 and chassis 900. Shank groove 740A may include a shoulder in bolt shank 730A which orients bolt 705A with respect to pin 715A with shank groove 740A. The shoulder of shank bolt 705A merges with helically inclined detent 725A to allow helically inclined detent to slide along pin 715A when bolt 705A is tightened or untightened. In this manner, bolt 705A mechanically locks via detent 725A with chassis 900 for a solid and repeatable interface.

A front portion of chassis 900 may implement structures corresponding to those shown in FIG. 9 and operate in the same manner to those features as discussed with respect to FIG. 9, above. For example, a back portion of chassis 900 may include a mounting hole 710B which accepts a bolt 705B allowing bolt 705B to enter to an internal portion of chassis 900. Bolt 705B may be held in place within mounting hole 710B by pin 715B. Chassis 900 may include a pinhole 720B which accepts pin 715B such that pin 715B resides against bolt 705B when bolt 705B is inserted into mounting hole 710B. Bolt 705B may be fitted with a helically inclined detent 725B. Helically inclined detent 725B, may be sized to fit with pin 720B. As bolt 705B is turned, bolt 705B is tightened (e.g., compressed) against a rifle stock. Friction between pin 720B and helically inclined detent 725B may hold bolt 705B in place. Bolt 705B may be fitted with a spacer 805B which provides for a rigid connection between a rifle stock and chassis 900, as will be described below.

As shown in FIG. 9, mounting hole 710B, shaped to accept bolt 705B, is installed in chassis 900 to allow bolt 705B access to pin 715B. When installed through a rifle stock via stock bolt hole 925B, bolt 705B is rotated, rotating the relative position of the point of contact between pin 715B and helically inclined detent 725B along the bolt shank 730B toward bolt head 735B which causes compression between bolt 705B compressing a rifle stock (discussed below) into chassis 900. In this manner, a rigid connection may be made between a rifle stock and chassis 900 to ensure that the rifle stock is secured to chassis 900 without movement between chassis 900 and the rifle stock. Bolt 705B may further include keyed hole 745B to allow bolt 705B to be easily tightened. Keyed hole 745B may be designed to accommodate what is conventionally called an Allen head screw, a Phillips head screw, a slotted head screw, or other keyed hole types known to those of ordinary skill in the art. Bolt 705B may also be designed with a shank groove 740A on one side of the end of bolt 705B. The shank groove 740B may allow bolt 705B to pass by pin 715B when inserted into mounting hole 710B. Thus, shank groove 740B may be a flat surface milled or cut into bolt 705B to a certain length of the bolt. The length of shank groove 740B may correspond to helically inclined detent 725B such that when bolt 705B is turned, pin 715B interacts with detent 725B to provide a secure attachment between stock 905 and chassis 900. Shank groove 740B may include a shoulder in bolt shank 730B which orients bolt 705B with respect to pin 715B with shank groove 740B. The shoulder of shank bolt 705B merges with helically inclined detent 725B to allow helically inclined detent to slide along pin 715B when bolt 705B is tightened or untightened. In this manner, bolt 705B mechanically locks via detent 725B with chassis 900 for a solid and repeatable interface.

Chassis 900 may include other elements which support the function of a bolt action rifle. For example, chassis 900 may optionally be fitted with a recess 145 (not shown in FIG. 9), a bolt recess 150 (not shown in FIG. 9) which allows a bolt action rifle to be properly opened and closed, and a trigger guard 155 which is intended to prevent a trigger from being accidentally actuated. Chassis 900 may further include a spring 160 (not shown in FIG. 9) which facilitates insertion and removal of a magazine (or magazine plate) for magazine 165.

It is further noted that the foregoing description has been described with respect to a bolt action rifle. However, this is not meant to disinclude the use of a chassis with other types of rifles having other types of actions. For example, it has been conceived that a chassis, such as chassis 100, chassis 400, or chassis 900 may connect to a semi-automatic rifle using locking pins in lieu of take down screws which connect chassis 100, chassis 400, or chassis 900 to a receiver of a semi-automatic rifle. Similarly, it has been conceived that a chassis, such as chassis 100, chassis 400, or chassis 900 may be implemented for any rifle such as a fully automatic rifle, a semi-automatic rifle, a lever action rifle, or any other type of rifle. The disclosure is not limited to the use of a chassis with only a bolt action rifle action as a chassis may be implemented to conform with or attach to any type of rifle receiver with trivial changes for connecting to another type of rifle action.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A chassis, comprising:

an internal portion which connects to a bolt action rifle action of a first type by takedown screw holes located to correspond with corresponding screw holes in the bolt action rifle action of the first type;

an external portion which connects to a rifle stock by mounting holes which are located to correspond with corresponding bolt holes in the rifle stock, wherein the takedown screw holes extend through the external portion and are inaccessible through the rifle stock, a pinhole in a side of the external portion of the chassis which intersects the mounting holes in the external portion of the chassis; and a trigger guard, the trigger guard included as part of the chassis and formed in the external portion of the chassis between the mounting holes.

2. The chassis of claim 1, wherein the rifle stock is universal to the chassis.

3. The chassis of claim 1, wherein a bolt is disposed in a mounting hole.

4. The chassis of claim 3, wherein the mounting hole extends through the rifle stock and the chassis.

5. The chassis of claim 4, wherein the bolt includes a helically inclined detent which interacts with the pin within the internal portion of the chassis to secure the rifle stock to the chassis.

6. The chassis of claim 5, wherein turning the bolt causes the helically inclined detent to interact with the pin by drawing the bolt head into contact with the rifle stock.

7. A chassis, comprising:

an internal portion which connects to a rifle action of a first type by takedown screw holes located to correspond with corresponding screw holes in the rifle action of the first type;

an external portion which connects to a rifle stock, by mounting holes which are located to correspond with corresponding bolt holes in the rifle stock, wherein the takedown screw holes extend through the external portion and are inaccessible through the rifle stock;

a pinhole in a side of the external portion of the chassis which intersects the mounting holes in the external portion of the chassis; and a trigger guard, the trigger guard included as part of the chassis and formed in the external portion of the chassis between the mounting holes.

8. The chassis of claim 7, wherein the rifle stock is universal to the chassis.

9. The chassis of claim 7, wherein a bolt is disposed in a mounting hole.

10. The chassis of claim 9, wherein the mounting hole extends through the rifle stock and the chassis.

11. The chassis of claim 10, wherein detent is a helically inclined detent in the bolt which interacts with the pin within the internal portion of the chassis to secure the rifle stock to the chassis.

12. The chassis of claim 11, wherein turning the bolt causes the helically inclined detent to interact with the pin by drawing the bolt head into contact with the rifle stock.

13. The chassis of claim 7, further comprising a bolt, the bolt including a spacer.

14. The chassis of claim 13, wherein the bolt includes a keyed hole in a head of the bolt.

15. The chassis of claim 7, wherein the rifle action is a semiautomatic rifle action.

* * * * *